US005489064A

United States Patent [19]

Shively

[11] Patent Number: 5,489,064

[45] Date of Patent: Feb. 6, 1996

[54] MAIL BOX DELIVERY INDICATOR FLAG

[76] Inventor: James B. Shively, 340 E.D.L. Sargent Dr., Apt. 14, Cedar City, Utah 84720

[21] Appl. No.: 338,439

[22] Filed: Nov. 14, 1994

Related U.S. Application Data

[63] Continuation-in-part of Ser. No. 24,010, Jun. 6, 1994, which is a continuation of Ser. No. 2,997, Apr. 15, 1993, abandoned.

[51] Int. Cl.[6] ..... B65D 91/00

[52] U.S. Cl. ..... 232/34

[58] Field of Search ..... 232/34, 35

[56] References Cited

U.S. PATENT DOCUMENTS

| | | | |
|---|---|---|---|
| 1,598,096 | 8/1926 | Maserang | 232/34 |
| 2,484,718 | 10/1949 | McCullar | 232/35 |
| 2,730,298 | 1/1956 | Haserodt | 232/35 |
| 2,843,316 | 7/1958 | Auger | 232/34 |
| 3,072,322 | 1/1963 | Van Meter | 232/34 |
| 3,386,649 | 6/1968 | Joyce | 232/34 |
| 4,316,575 | 2/1982 | VanDarwarka | 232/34 |
| 4,771,941 | 9/1988 | Bowman et al. | 232/35 |
| 4,840,307 | 6/1989 | Hartman | 232/34 |
| 5,385,295 | 1/1995 | McNair | 232/35 |

*Primary Examiner*—Michael J. Milano

[57] ABSTRACT

A flag for visually indicating delivery of mail into an associated mail box. The inventive device includes a flag member pivotally mountable to a mail box by a spring loaded mounting assembly. A retaining assembly is coupled to the flag member for selectively securing the flag into a flat position relative to the mail box. The retaining assembly can be selectively released by mail delivery personnel to permit the spring loaded hinge to bias the flag into an upright position to indicate delivery of the mail.

7 Claims, 3 Drawing Sheets

MAIL BOX DELIVERY INDICATOR FLAG

RELATED APPLICATION

This application is a continuation-in-part of application, Ser. No. 29/024,010, filed Jun. 6, 1994, which, in turn, is a continuation of prior application Ser. No. 29/002,997, filed Apr. 15, 1993, now abandoned.

BACKGROUND OF THE INVENTION

1. Field of the Invention

The present invention relates to signalling devices and more particularly pertains to a flag for visually indicating delivery of mail into an associated mail box.

2. Description of the Prior Art

The use of signalling devices is known in the prior art. More specifically, signalling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art signalling devices include U.S. Pat. Nos. 5,076,337; 5,023,595; 4,986,467; 4,113,170; and 3,827,627.

While these devices fulfill their respective, particular objectives and requirements, the aforementioned patents do not disclose a flag for visually indicating delivery of mail into an associated mail box which includes a flag member pivotally mountable to a mail box by a spring loaded mounting assembly, and a retaining assembly coupled to the flag member for selectively securing the flag into a flat position relative to the mail box, wherein the retaining assembly can be selectively operated by mail delivery personnel to permit the spring loaded hinge to bias the flag into an upright position to indicate delivery of the mail.

In these respects, the mail box delivery indicator flag according to the present invention substantially departs from the conventional concepts and designs of the prior art, and in so doing provides an apparatus primarily developed for the purpose of visually indicating delivery of mail into an associated mail box.

SUMMARY OF THE INVENTION

In view of the foregoing disadvantages inherent in the known types of signalling devices now present in the prior art, the present invention provides a new mail box delivery indicator flag construction wherein the same can be utilized for visually indicating delivery of mail into an associated mail box. As such, the general purpose of the present invention, which will be described subsequently in greater detail, is to provide a new mail box delivery indicator flag apparatus and method which has many of the advantages of the signalling devices mentioned heretofore and many novel features that result in a mail box delivery indicator flag which is not anticipated, rendered obvious, suggested, or even implied by any of the prior art signalling devices, either alone or in any combination thereof.

To attain this, the present invention generally comprises a flag for visually indicating delivery of mail into an associated mail box. The inventive device includes a flag member pivotally mountable to a mail box by a spring loaded mounting assembly. A retaining assembly is coupled to the flag member for selectively securing the flag into a flat position relative to the mail box. The retaining assembly can be selectively released by mail delivery personnel to permit the spring loaded hinge to bias the flag into an upright position to indicate delivery of the mail.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mail box delivery indicator flag apparatus and method which has many of the advantages of the signalling devices mentioned heretofore and many novel features that result in a mail box delivery indicator flag which is not anticipated, rendered obvious, suggested, or even implied by any of the prior art signalling devices, either alone or in any combination thereof.

It is another object of the present invention to provide a new mail box delivery indicator flag which may be easily and efficiently manufactured and marketed.

It is a further object of the present invention to provide a new mail box delivery indicator flag which is of a durable and reliable construction.

An even further object of the present invention is to provide a new mail box delivery indicator flag which is susceptible of a low cost of manufacture with regard to both materials and labor, and which accordingly is then susceptible of low prices of sale to the consuming public, thereby making such mail box delivery indicator flags economically available to the buying public.

Still yet another object of the present invention is to provide a new mail box delivery indicator flag which provides in the apparatuses and methods of the prior art some of the advantages thereof, while simultaneously overcoming some of the disadvantages normally associated therewith.

Still another object of the present invention is to provide a new mail box delivery indicator flag for visually indicating delivery of mail into an associated mail box.

Yet another object of the present invention is to provide a new mail box delivery indicator flag which includes a flag member pivotally mountable to a mail box by a spring loaded mounting assembly, and a retaining assembly coupled to the flag member for selectively securing the flag into a flat position relative to the mail box, wherein the retaining assembly can be selectively operated by mail delivery personnel to permit the spring loaded hinge to bias the flag into an upright position to indicate delivery of the mail.

Even still another object of the present invention is to provide a new mail box delivery indicator flag of the aforementioned structure which further includes an elongated mounting bar for securing a plurality of the mail box delivery indicator flags to a plural mail box assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
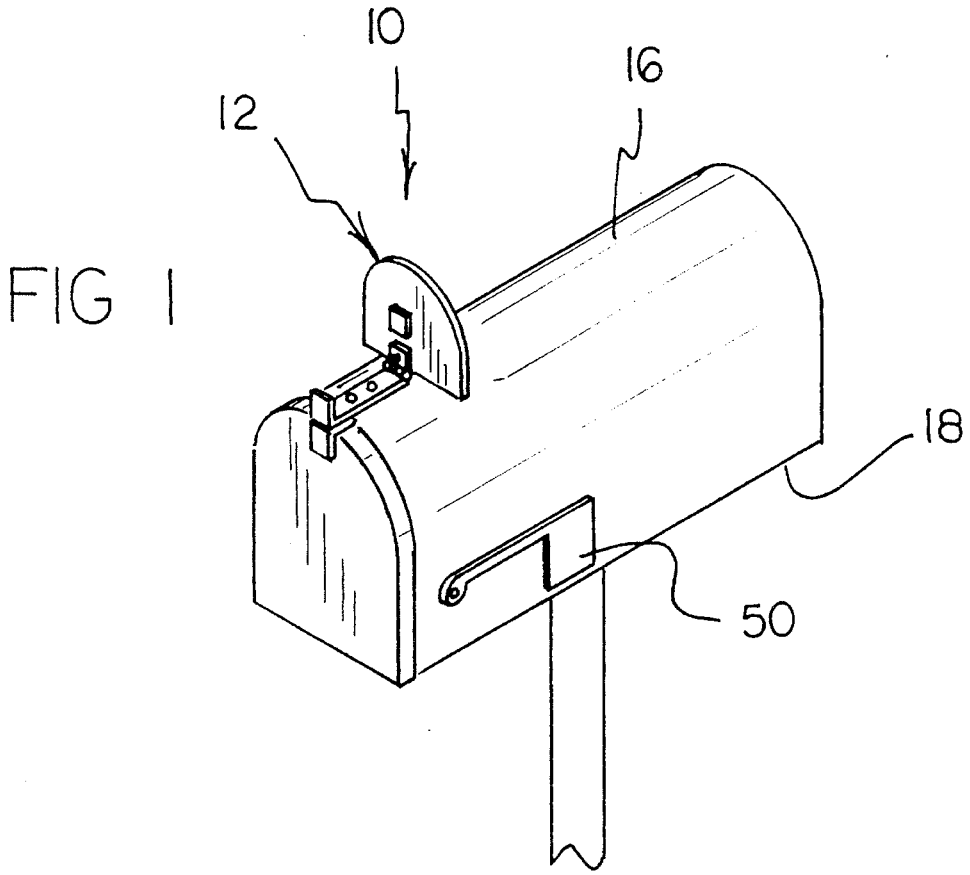
FIG. 1 is an isometric illustration a mail box delivery indicator flag according to the present invention.

With reference now to the drawings, and in particular to FIGS. 1–6 thereof, a new mail box delivery indicator flag embodying the principles and concepts of the present invention and generally designated by the reference numeral 10 will be described.

More specifically, it will be noted that the mail box delivery indicator flag 10 comprises a flag means 12 for visually indicating a predetermined condition, i.e. delivery of mail. A pivotal mounting means 14 is coupled to the flag means and mountable to the upper surface 16 of a mail box 18 for pivotally mounting the flag means relative to the mail box, as shown in FIG. 1. A retaining means 20 is also coupled to the flag means 12 and is operable for selectively securing the flag means in a flat position oriented parallel to the upper surface 16 of the mail box 18.

Figure 2:
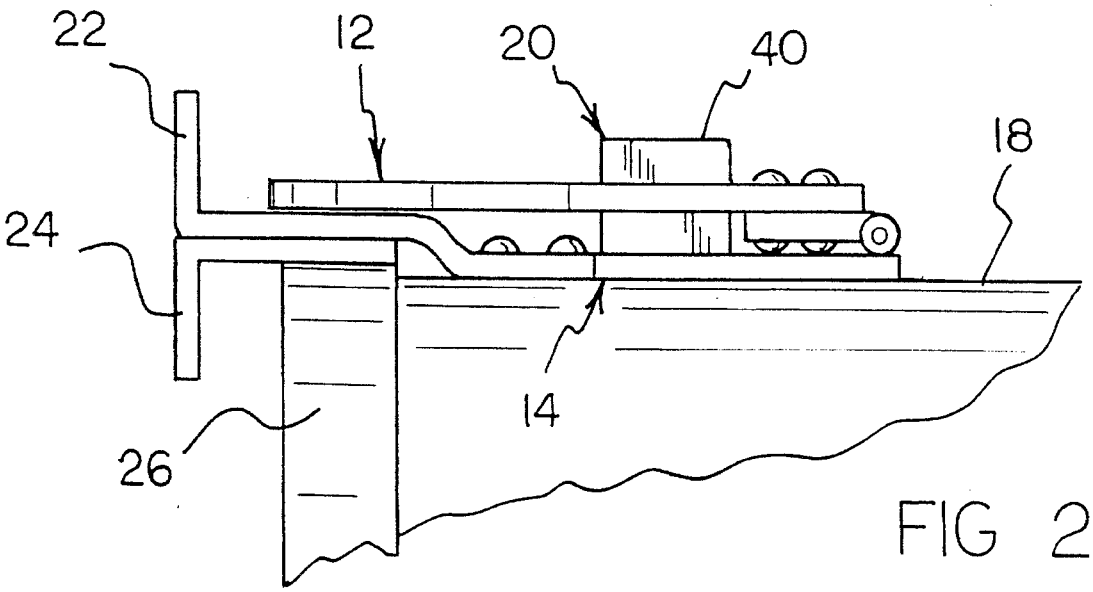
FIG. 2 is a side elevation view of the invention.

As best illustrated in FIG. 2, it can be shown that the pivotal mounting means 14 of the present invention 10 is preferably mounted proximal to a box handle 22 of the mail box 18 which is typically located immediately above a door handle 24 coupled to a door 26 of the mail box. By this positioning, the retaining means can be easily operated by mail delivery personnel during the necessary opening and closing of the door of the mail box in a manner which will subsequently be described in more detail.

Figure 3:
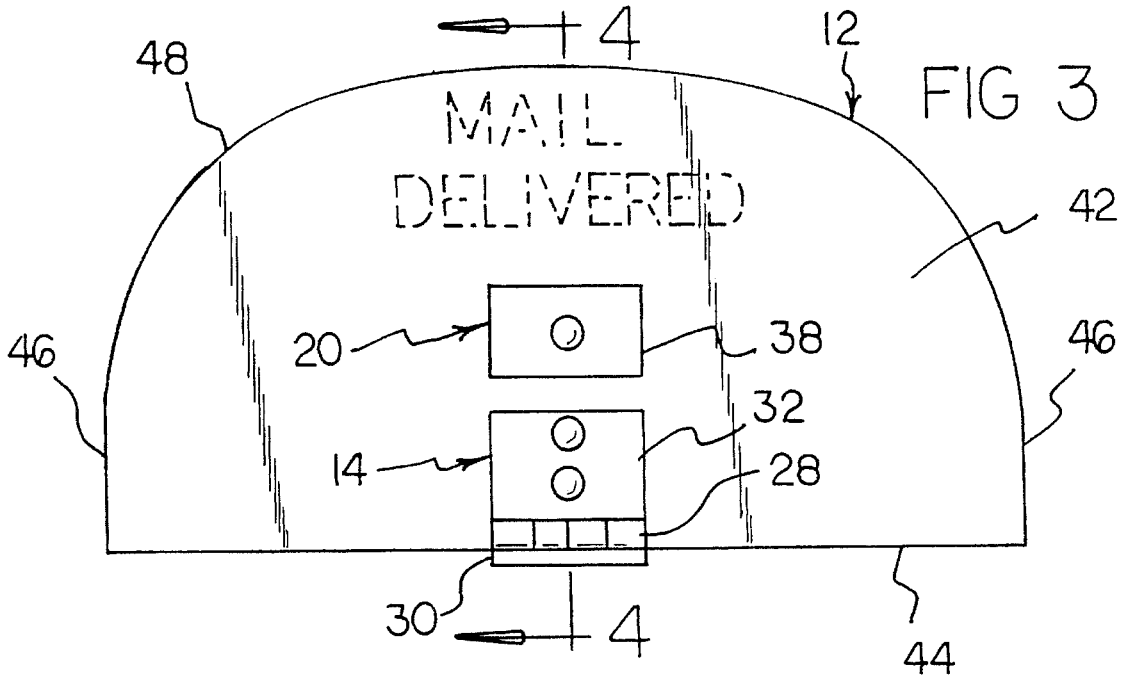
FIG. 3 is a front elevation view thereof.
Figure 4:
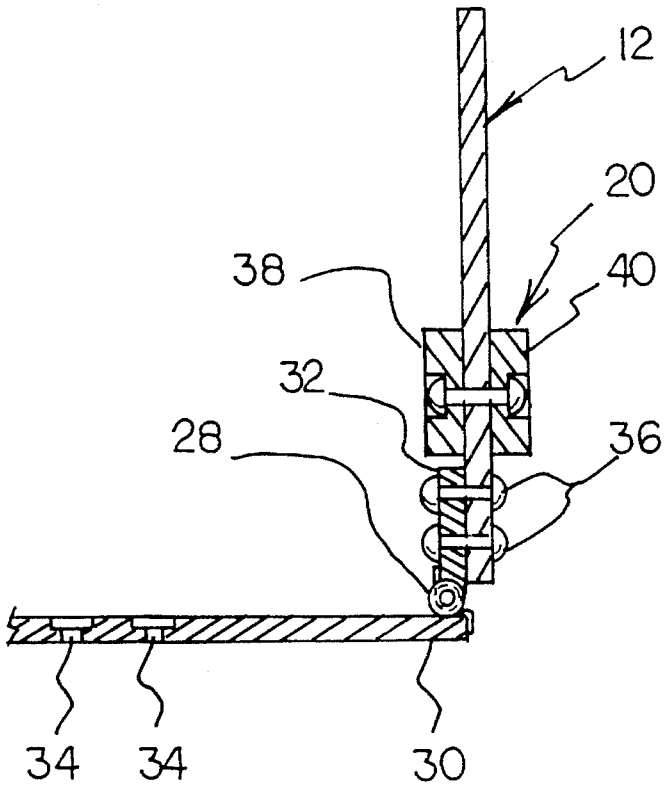
FIG. 4 is a cross sectional view taken along line 4—4 of FIG. 3.

Referring now to FIGS. 3 and 4, it can be shown that the mounting means 14 according to the present invention 10 comprises a spring loaded hinge 28 having a first hinge plate 30 pivotally mounted to a second hinge plate 32. The first hinge plate 30 is shaped so as to define at least one and preferably a pair of mounting apertures 34 permitting the direction of fasteners therethrough to engage the mail box to secure the mounting means 14 relative thereto. The second hinge plate 32 similarly includes a pair of unlabeled mounting apertures through which a pair of unlabeled fasteners such as rivets 36 or screws extend into engagement with the flag means 12. An unlabeled spring is engaged to both the first hinge plate 30 and the second hinge plate 32 and is operable to bias the second hinge plate into a substantially orthogonal orientation relative to the first hinge plate 30, as shown in FIGS. 1, 2, and 4. By this structure, the first hinge plate 30 can be secured to the upper surface 16 of the mail box 18, whereby the flag means 12 is supported in a substantially orthogonal relationship to the upper surface of the mail box as shown in FIG. 1.

As best shown in FIGS. 2 through 4, the retaining means 20 of the present invention 10 preferably comprises a first magnetic plate 38 secured to a first face of the flag means 12, and a second magnetic plate 40 secured to an opposed second face of the flag means. As shown in FIG. 4, the magnetic plates 38 and 40 are preferably secured to the opposed faces of the flag means 12 by a single unlabeled rivet or other fastener directed therethrough. By this structure, the flag means can be pivotally biased towards the mail box 18 so as to position the first magnetic plate 38 into abutting contact with the first hinge plate 30 of the spring loaded hinge 28. The first hinge plate 30 is formed of a substantially ferrous material, whereby the first magnetic plate 38 will retain the flag means in a substantially parallel orientation relative to the first hinge plate and the upper surface 16 of the mail box 18. Alternatively, should the mail box to which the present invention is attached during use be made of a substantially ferrous material, the flag can be folded towards the mail box 18 so as to position the second magnetic plate 40 into an abutting relationship with the upper surface 16 thereof, whereby the second magnetic plate 40 will retain the flag means 12 in a substantially parallel orientation relative to the upper surface of the mail box.

Referring to FIG. 3, the flag means 12 of the invention 10 preferably comprises a substantially planar member 42 having a straight lower edge 44, with a pair of spaced and parallel straight lateral edges 46 extending substantially orthogonally from respectively opposed ends of the straight lower edge 44. An arcuate upper edge 48 extends between upper ends of the lateral edges 46 to completely define the exterior perimeter of the planar member 42. The arcuate upper edge 48 of the planar member serves to guide a mail delivery person's hand towards the standard mail box flag 50 during a mail delivering procedure. In other words, as the mail delivery person reaches for the door handle 24 of the mail box 18 to open the door 26 thereof, the delivery person's hand can be slid along the arcuate upper edge 48 of the flag means 12 towards one of the straight lateral edges 46 thereof. Upon a positioning of the mail delivery person's hand at the straight lateral edge 46 proximal to the standard mail box flag 50, the flag means 12 of the present invention 10 can be biased away from the mail box 18 to effect extension of the flag means into the orthogonal position indicating delivery of mail. At the same time, the mail delivery person's hand will be located proximal to the standard mail box flag 50, whereby a pivotal collapsing of the mail box flag can thus be accomplished if such flag is in a raised position. Thus, the shape of the planar member of the flag means 12 permits the mail delivery person's hand to continue through a single motion to effect raising of the flag means 12 and collapsing of the standard mail box flag 50 if so raised.

Figure 5:
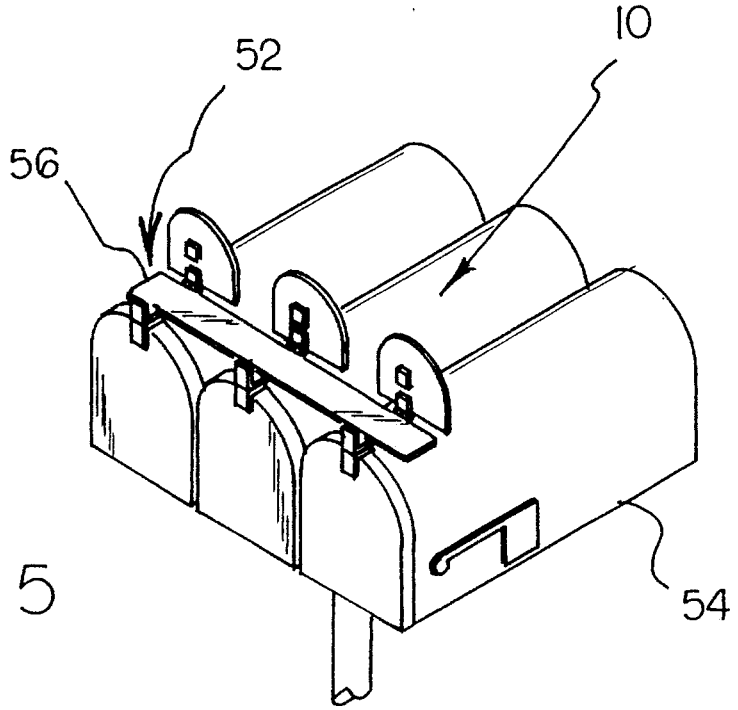
FIG. 5 is an isometric illustration of the present invention further including a plural mounting means.
Figure 6:
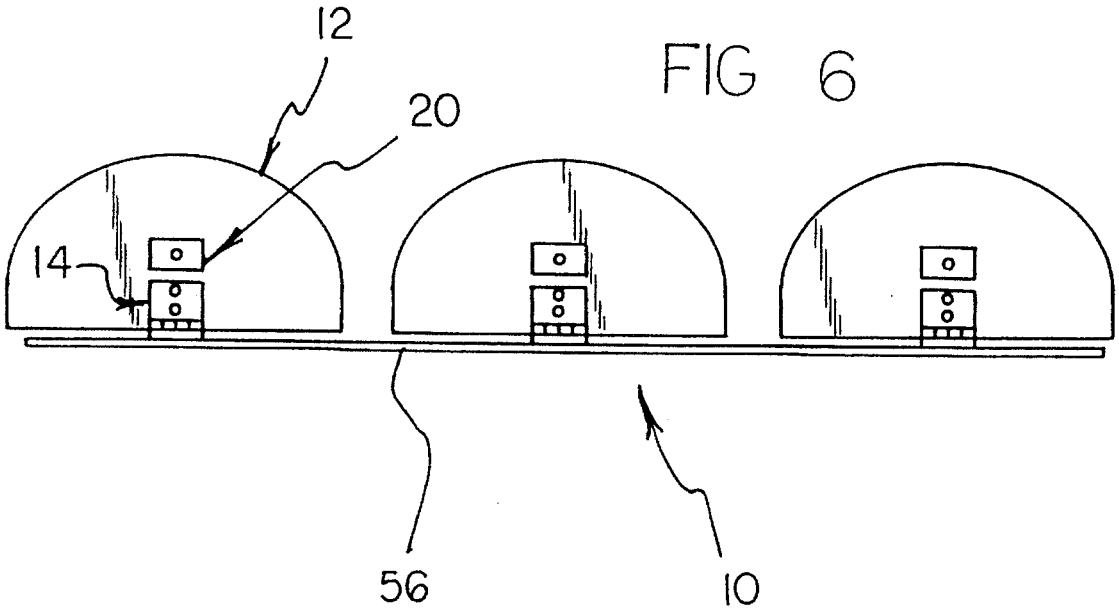
FIG. 6 is a front elevation view of the present invention including the plural mounting means.

As shown in FIGS. 5 and 6, the present invention may further comprise a plural mounting means 52 for mounting a plurality of the mail box delivery indicator flags 10 to a plural mail box assembly 54. To this end, the plural mounting means 52 preferably comprises an elongated mounting bar 56 to which the pivotal mounting means 14 of each of the mail box delivery indicator flags 10 is mounted. The elongated mounting bar can thus be secured to any one or all of the mail boxes of the plural mailbox assembly to effect simultaneous mounting of the plurality of mail box delivery indicator flags 10 thereto.

In use, the mail box delivery indicator flag 10 according to the present invention 10 can be easily coupled to a single mail box 18, or a plural mail box assembly 54 as described above. The flag means 12 can thus be retained in a parallel orientation relative to the upper surface 16 of the mail box 18 by the retaining means to indicate an absence of delivered mail within the mail box. Upon delivery of mail, the mail delivery person can simply raise the flag means 12 to indicate delivery of mail. If the standard mail box flag 50 has been raised, a single hand motion can be executed by the mail delivery person to effect raising of the flag means 12 and collapsing of the standard mail box flag 50.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mail box delivery indicator flag comprising:

a flag means for visually indicating a predetermined condition;

a pivotal mounting means coupled to the flag means and mountable to an upper surface of a mail box for pivotally mounting the flag means relative to the mail box;

and, a retaining means coupled to the flag means for selectively securing the flag means in a flat position oriented parallel to the upper surface of the mail box wherein the pivotal mounting means comprises a spring loaded hinge having a first hinge plate pivotally mounted to a second hinge plate, with the second hinge plate being mounted to a portion of the flag means, the spring loaded hinge including a spring engaged to both the first hinge plate and the second hinge plate so as to bias the second hinge plate into a substantially orthogonal orientation relative to the first hinge plate;

wherein the first hinge plate is comprised of a substantially ferrous material, and further wherein the retaining means comprises a first magnetic plate secured to a first face of the flag means, whereby the flag means can be pivotally biased towards the first hinge plate so as to position the first magnetic plate into abutting contact with the first hinge plate of the spring loaded hinge, whereby the first magnetic plate will retain the flag means in a substantially parallel orientation relative to the first hinge plate;

wherein the retaining means further comprises a second magnetic plate secured to an opposed second face of the flag means.

2. The mail box delivery indicator flag of claim 1, wherein the flag means comprises a substantially planar member having a straight lower edge, a pair of spaced and parallel straight lateral edges extending substantially orthogonally from respectively opposed ends of the straight lower edge, and an arcuate upper edge extending between upper ends of the lateral edges, the arcuate upper edge of the planar member being operable to guide a mail delivery person's hand towards one of the lateral edges of the planar member.

3. The mail box delivery indicator flag of claim 1, and further comprising a plural mounting means for mounting a plurality of the mail box delivery indicator flags to a plural mail box assembly.

4. A mail box delivery indicator flag comprising:

a mailbox having an upper surface, a box handle projecting substantially parallel to the upper surface of the mail box, a door handle positioned immediately below the box handle and being coupled to a door of the mail box, and a pivotally mounted standard mail box flag;

a flag means for visually indicating a predetermined condition;

a pivotal mounting means coupled to the flag means and mounted to the upper surface of a mail box proximal to the box handle thereof for pivotally mounting the flag means relative to the mail box;

and, a retaining means coupled to the flag means for selectively securing the flag means in a flat position oriented parallel to the upper surface of the mail box;

wherein the pivotal mounting means comprises a spring loaded hinge having a first hinge plate pivotally mounted to a second hinge plate, the first hinge plate being secured to the upper surface of the mail box, with the second hinge plate being mounted to a portion of the flag means, the spring loaded hinge including a spring engaged to both the first hinge plate and the second hinge plate so as to bias the second hinge plate into a substantially orthogonal orientation relative to the first hinge plate and the upper surface of the mail box;

wherein the first hinge plate is comprised of a substantially ferrous material, and further wherein the retaining means comprises a first magnetic plate secured to a first face of the flag means, whereby the flag means can be pivotally biased towards the first hinge plate so as to position the first magnetic plate into abutting contact with the first hinge plate of the spring loaded hinge, whereby the first magnetic plate will retain the flag means in a substantially parallel orientation relative to the first hinge plate;

wherein the flag means comprises a substantially planar member having a straight lower edge, a pair of spaced and parallel straight lateral edges extending substantially orthogonally from respectively opposed ends of the straight lower edge, and an arcuate upper edge extending between upper ends of the lateral edges, the arcuate upper edge of the planar member being operable to guide a mail delivery person's hand towards one of the lateral edges of the planar member;

wherein the retaining means further comprises a second magnetic plate secured to an opposed second face of the flag means.

5. A method for delivering of mail comprising the steps of:

providing a mail box delivery indicator flag comprising a mailbox having an upper surface, a box handle projecting substantially parallel to the upper surface of the mail box, a door handle positioned immediately below the box handle and being coupled to a door of the mail box, and a pivotally mounted standard mail box flag; a flag means for visually indicating a predetermined condition; a pivotal mounting means coupled to the flag means and mounted to the upper surface of a mail box proximal to the box handle thereof for pivotally mounting the flag means relative to the mail box; and, a retaining means coupled to the flag means for selectively securing the flag means in a flat position oriented parallel to the upper surface of the mail box; wherein the pivotal mounting means comprises a spring loaded hinge having a first hinge plate pivotally mounted to a second hinge plate, the first hinge plate being secured to the upper surface of the mail box, with the second hinge plate being mounted to a portion of the flag means, the spring loaded hinge including a spring engaged to both the first hinge plate and the second hinge plate so as to bias the second hinge plate into a substantially orthogonal orientation relative to the first hinge plate and the upper surface of the mail box; wherein the first hinge plate is comprised of a substantially ferrous material, and further wherein the retaining means comprises a first magnetic plate secured to a first face of the flag means, whereby the flag means can be pivotally biased towards the first hinge plate so as to position the first magnetic plate into abutting contact with the first hinge plate of the spring loaded hinge, whereby the first magnetic plate will retain the flag means in a substantially parallel orientation relative to the first hinge plate; wherein the flag means comprises a substantially planar member having a straight lower edge, a pair of spaced and parallel straight lateral edges extending substantially orthogonally from respectively opposed ends of the straight lower edge, and an arcuate upper edge extending between upper ends of the lateral edges, the arcuate upper edge of the planar member being operable to guide a mail delivery person's hand towards one of the lateral edges of the planar member;

sliding a delivery person's hand along the arcuate upper edge of the flag means towards one of the straight lateral edges thereof;

biasing the flag means away from the mail box to effect extension of the flag means into an orthogonal position relative to the upper surface thereof to indicate delivery of mail;

sliding the delivery person's hand from the flag means and into contact with the standard mail box flag;

and, collapsing the standard mail box flag.

6. The method of claim 5, and further comprising the steps of:

opening the door of the mail box; and, inserting mail into the mail box.

7. The method of claim 6, and further comprising the step of:

closing the door of the mail box.

* * * * *